United States Patent [19]

Bednar

[11] 4,326,299

[45] Apr. 27, 1982

[54] SOCCER CUFF

[76] Inventor: Robert M. Bednar, 8506 Goldfinch Way, West Chester, Ohio 45069

[21] Appl. No.: 149,038

[22] Filed: May 12, 1980

[51] Int. Cl.[3] ..... A41D 13/00

[52] U.S. Cl. ..... 2/22

[58] Field of Search ..... 2/16, 22, 24

[56] References Cited

U.S. PATENT DOCUMENTS 3,381,989 5/1968 Thomas ..... 2/162

3,465,364 9/1969 Edelson ..... 2/22

3,990,440 11/1976 Gaylord ..... 2/24

FOREIGN PATENT DOCUMENTS 663914 4/1929 France ..... 2/24

*Primary Examiner*—Doris L. Troutman

[57] ABSTRACT

A protective cuff for the ankle has a padded cover which is secured about the ankle. An elastic cover is positioned over the padded cover to protect the ankle, achilles tendon and foot from injury during athletic endeavor.

8 Claims, 5 Drawing Figures

SOCCER CUFF

BRIEF DESCRIPTION OF THE INVENTION

This invention pertains to a protective cuff to be worn over the ankle which provides a cushion from blows sustained in athletic endeavor, such as soccer.

DESCRIPTION OF THE PRIOR ART

In the past, there have been various types of guards to provide protection of the body. Knee pads, shin guards and ankle guards have been developed. However, most of these guards are either designed for limited protection (knee and shin pads) or unsuitable for strenuous physical activity such as running and jumping. For example, U.S. Pat. No. 3,383,708 shows an ankle guard with straps which have a tendency to produce blisters and chafened area if worn for soccer play. Furthermore, such a guard necessarily causes some restriction of movement in the foot and ankle which is undesirable in sports where maximum dexterity of the foot is required. Similar guards have proven to be expensive to manufacture and of limited utility. Therefore, it would be desirable to provide a cuff to fit about the ankle which will provide omnidirectional protection with a minimum of restriction to movement.

The present invention comprises a soccer cuff which protects the ankle bone, achilles tendon and top portion of the foot for soccer players and the like. In the past, no guard has customarily been worn for said area. Boots have been used to cushion the foot from kicks but they leave the ankle and tendon exposed and restrict movemenet.

Accordingly, it is an object of the present invention to provide a soccer cuff which affords omnidirectional protection.

It is a further object of the invention to provide a soccer cuff that can be easily donned or removed after other equipment such as shoes or kneeguards have already been put on.

A further object of the invention is to provide a non-rigid, non-protruding soccer cuff which can be worn without violating the rules of the game.

A still further object of the invention is to provide a soccer cuff which is non-binding and non-restrictive so as to avoid interfering with the wearer's ability to respond.

It is another object of the present invention to provide a soccer cuff that is inexpensive to manufacture and easily repairable.

Another object of the present invention is to provide a soccer cuff which will stay in place, resistant to both circumferential rotation and axial displacement.

A still further object of the present invention is to provide a soccer cuff which utilizes a foam padding to absorb a direct blow to the ankle An additional object of the present invention is to provide a soccer cuff which is simple to put on and remove.

The foregoing and other objects of the invention will become further apparent hereinafter and in the drawings of which:

DRAWINGS

Figure 1:
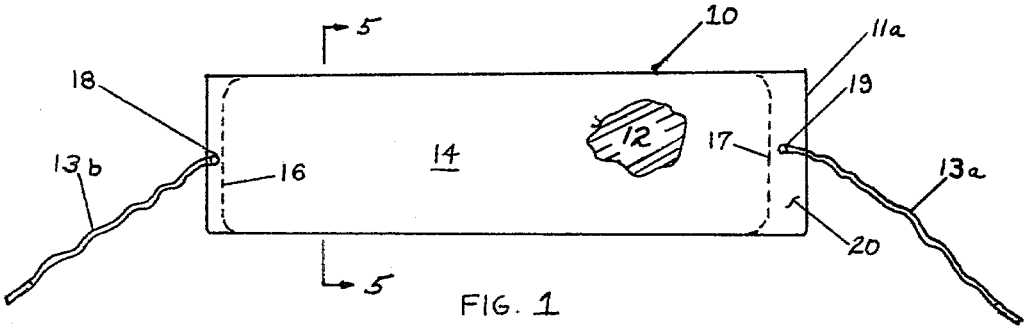
FIG. 1 is a plan view of the padded cover of the present invention partially broken away to show the inner construction.
Figure 5:
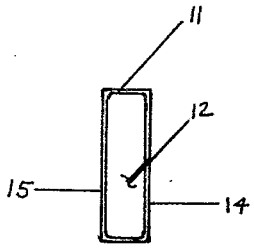
FIG. 5 is a sectional view of the padded cover taken along line 5—5 of FIG. 1 illustrating its construction.

Referring to FIG. 1 and FIG. 5 of the drawings, the numeral 10 indicates generally the padded cover of the invention which includes elongate hollow member 11 defined by inner panel 14, outer panel 15 and closed ends 16 and 17, respectively. Confined within said hollow member 11 and substantially filling same is foam pad 12. Preferably, hollow member 11 is formed from a tubular section of suitable fabric such as cotton or the like which is stitched close at either end and foam pad 12 which is comprised of resilient, foam-like material such as polyethylene foam, is inserted in the tube. Tie strings 13*a* and 13*b* are affixed to either end of hollow member 10, such as by eyelets 18 and 19. Eyelet 19 is spaced inwardly with respect to the end 11*a* of the padded cover so as to form flap 20.

Figure 2:
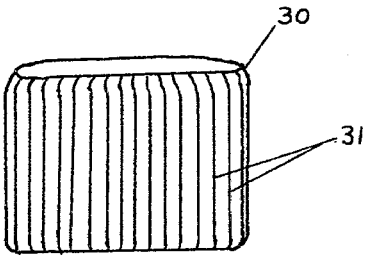
FIG. 2 is a plan view of the elastic cover of the present invention.

Referring now to FIG. 2 of the drawings, numeral 30 designates the elastic cover of the invention generally. Said elastic cover is tubular in construction and resilient. It is sized initially to snugly fit around the wearer's ankle yet suitably elastic to allow sufficient expansion to permit its manipulation over the foot either during application or removal. Such resiliency may be afforded, in one embodiment of the present invention, by expandible ribs 31. Again, elastic cover 30 is fabricated from a soft fabric which can be of any predetermined color. It can be appreciated that said elastic cover operates to fix the combination in place on the wearer's ankle.

Figure 4:
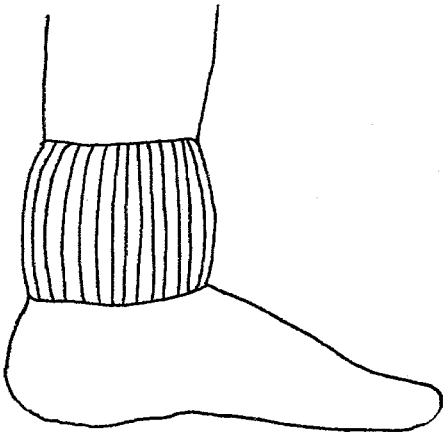
FIG. 4 is a side elevation of a wearer's foot with the soccer cuff positioned around the ankle.
Figure 3:
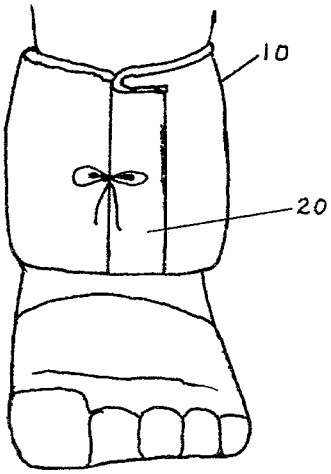
FIG. 3 is an elevation of a wearer's foot with the padded cover secured around the ankle with flap bent back to show the connection.

FIG. 3 illustrates the padded cover 10 in its normal relationship to the foot of the wearer. The unit is wrapped around the ankle proximate to its conjunction with the foot and joined by means of tie strings 13*a* and 13*b* on the proximal side of the ankle. Flap 20 is then folded over the connection. Afterwards, elastic cover 30 is pulled over the foot and into proximate, covering relationship to padded cover 10 as shown in FIG. 4. By virtue of its elastic properties, cover 30 snugly and firmly retains the soccer cuff in place over the ankle and achilles tendon area.

It can thus be seen that a two-piece soccer cuff is provided which will protect the ankle and foot from injury. This is especially important for younger soccer players whose lack of control and coordination produce many misdirected kicks which would otherwise result in painful bruises or worse without the protection provided by the present invention. Likewise, because of its soft and resilient features, the soccer cuff cannot be used as a weapon, nor does it present any sharp edges or loose ends which would hinder a player's action or violate rules of the game. The instant invention is easily applied and held in place, is lightweight as well as durable. Importantly, there is no restraint imposed on the ankle region, the dexterity of which is so important for a soccer player. Moreover, the soccer cuff resists both rotation and axial displacement on the wearer's leg.

It will be understood by those skilled in the art, that equivalent fastening means could be substituted for the tie strings disclosed. Similarily, the elastic cover 30 could be provided with any color scheme desired so as to conform to pre-selected team colors or to contrast with other segments of the uniform. It is also apparent that the present invention can be utilized in conjunction with shin guards and/or knee guards to afford even better protection for the player's legs. The soccer cuff disclosed is simple in construction with parts that are easily replaceable and is very inexpensive. It is thus seen that the objects of the invention have been achieved.

What is claimed is:

1. A soccer coff comprising:

a. An elongate member, at least a portion of which comprises a pad of resilient foam-like material;

b. fastening means proximate opposite ends of said elongate member; and c. an elastic cuff, whereby said elongate member is attached around a wearer's ankle by said fastening means and said cuff is snugly juxtaposed around and covering said elongate member to provide protection from blows to the ankle, achilles tendon and foot of the wearer.

2. The soccer cuff as defined in claim 1, wherein said elongate member is hollow and said pad portion is confined within the hollow.

3. The soccer cuff as defined in claim 1, wherein said fastening means comprise two strings adapted to be tied together when said soccer cuff is worn.

4. The soccer cuff as defined in claim 1, wherein said elastic cuff is substantially the same size as said elongate member.

5. The soccer cuff as defined in claim 1, wherein said elastic cuff is ribbed.

6. The soccer cuff as defined in claim 1, wherein one of said fastening means is spaced farther from its proximate end than the other of said fastening means whereby a flap is formed which will cover said fastening means when fastened.

7. The soccer cuff as defined in claim 1, wherein said elongate member and said elastic cuff are fabricated from cotton or the like.

8. The soccer cuff as defined in claim 1, wherein said elastic cuff is tubular.

* * * * *